United States Patent [19]

Fenner

[11] Patent Number: 4,474,032

[45] Date of Patent: Oct. 2, 1984

[54] AUTOMATIC PLATE FREEZERS

[75] Inventor: Frank R. Fenner, Cleethorpes, England

[73] Assignee: Jackstone Froster Limited, Grimsby, England

[21] Appl. No.: 484,242

[22] Filed: Apr. 12, 1983

[30] Foreign Application Priority Data

Apr. 16, 1982 [GB] United Kingdom ..... 8211135

[51] Int. Cl.[3] ..... F25C 5/14

[52] U.S. Cl. ..... 62/341; 100/93 P

[58] Field of Search ..... 62/341; 100/93 P

[56] References Cited

U.S. PATENT DOCUMENTS

| | | | |
|---|---|---|---|
| 3,020,731 | 2/1962 | Knowles | 62/341 |
| 3,271,973 | 9/1966 | Amerio et al. | 62/341 |
| 4,180,987 | 1/1980 | McLaughlin | 62/341 |

*Primary Examiner*—Ronald C. Capossela

*Attorney, Agent, or Firm*—Scrivener, Clarke, Scrivener and Johnson

[57] ABSTRACT

An automatic plate freezer comprises a plurality of freezer plates which rest on a lower support connected by ties to an upper support. Each plate rests on the plate below via adjustable spacers and the upper support may be raised and lowered by jacks. In use, product to be frozen is loaded on the plate located at a loading level determined by sensors and the spacers associated with that plate are set to a value appropriate to the product in question. The jacks are then extended to lift the stack of plates until the plate just loaded is engaged by latches. The stack is then lowered, and the latches support all plates at and above the level of the latches. Lowering of the remaining plates continues until the sensors detect that the plate below that just loaded is at the loading level whereupon the cycle repeats.

9 Claims, 5 Drawing Figures

21
22
23
24
25
26
27
28
29
30
20
31
32
33

AUTOMATIC PLATE FREEZERS

This invention is concerned with improvements in and relating to plate freezers.

It is known to provide a plate freezer as shown in FIG. 1 of the accompanying drawings which is a diagrammatic elevation of an automatic plate freezer having an upper pressure plate 1 supporting a lower pressure plate 2 through tie rods 3 and movable by hydraulic jacks 4, a stack of freezer plates 5, located between the pressure plates, and supported by the pressure plate 2; and side guide frames 6 setting the path of the plates. The operation of this freezer comprises loading product, such as packets of food onto each plate 5 successively when the plate to be loaded is at an input level, the loading causing frozen product to be discharged from the other end of the plate. The successive loading begins with the stack of freezer plates and pressure plates at a lowermost position set by the jacks in which uppermost plate A is resting on plate latches 7 and the next plate B is suspended from plate A by link bolts 8 so that plates A and B are in an open condition with plate B at the input level and plates A and B spaced to allow incoming and outgoing product to slide along the surface of plate B. When plate B is fully loaded, the jacks extend thereby lifting the upper pressure plate 1, thereby the tie rods and hence the lower pressure plate and thus the complete stack less plate A until fixed spacers (not shown) on freezer plate B abut plate A. Fixed spacers are indicated at 9 to show how they are positioned on a plate. Then the upper plate A lifts with product in contact with adjacent surfaces of plates A and B but protected against squeezing between plates A and B by the fixed spacers. The lift of the jacks causes plate B to be engaged by the latches whereupon lift ceases and the jacks are allowed to retract, thereby lowering all the plates below plate B until plate C is at the input level. The sequence is then repeated. When all plates have been loaded the latches are locked out and the whole stack is lowered, the plates all being at minimum spacing set by the spacers and resting on lower pressure plate 2, the extra spacing which was provided between each adjacent pair of plates for loading purposes now being between plate A and the upper pressure plate.

The fixed spacers are each of a form comprising a channel secured to the upper surface of a plate and a spacer block held in place in each channel by clamping screws. To vary the spacer to accommodate product of different thickness, each block must be removed and replaced by a block of the new required size to give the required spacing. Further, it will be apparent that when different sized spacers are used the vertical position of the plates below the latches must be adjusted to ensure that each plate will be properly positioned at the same input or loading level. This adjustment can be made by adjusting the effective length of the tie rods which is a time consuming operation, subject to possibly disastrous error.

According to this invention, there is provided a plate freezer comprising a stack of freezer plates; spacer means between each pair of adjacent plates enabling each plate to be supported on the plate below with a spacing therebetween determined by the spacer means; latch means for supporting a plate located at the level of the latch means; and lifting-and-lowering means for sequentially lifting the plates in the stack to locate a plate for support by the latch means, and then lowering those plates in the stack located below the latch means until the plate next below the latch means is at a predetermined position, the lifting-and-lowering means being repeatedly operable to locate successive plates in the stack at the predetermined position, and the predetermined position being defined by sensor means which detect when a plate is at the predetermined position and then terminate lowering of the plate to maintain it in the predetermined position.

In order that the invention may be well understood reference will now be made to FIGS. 1 to 5 of the accompanying drawings in which.

Figures 2, 3, 4:
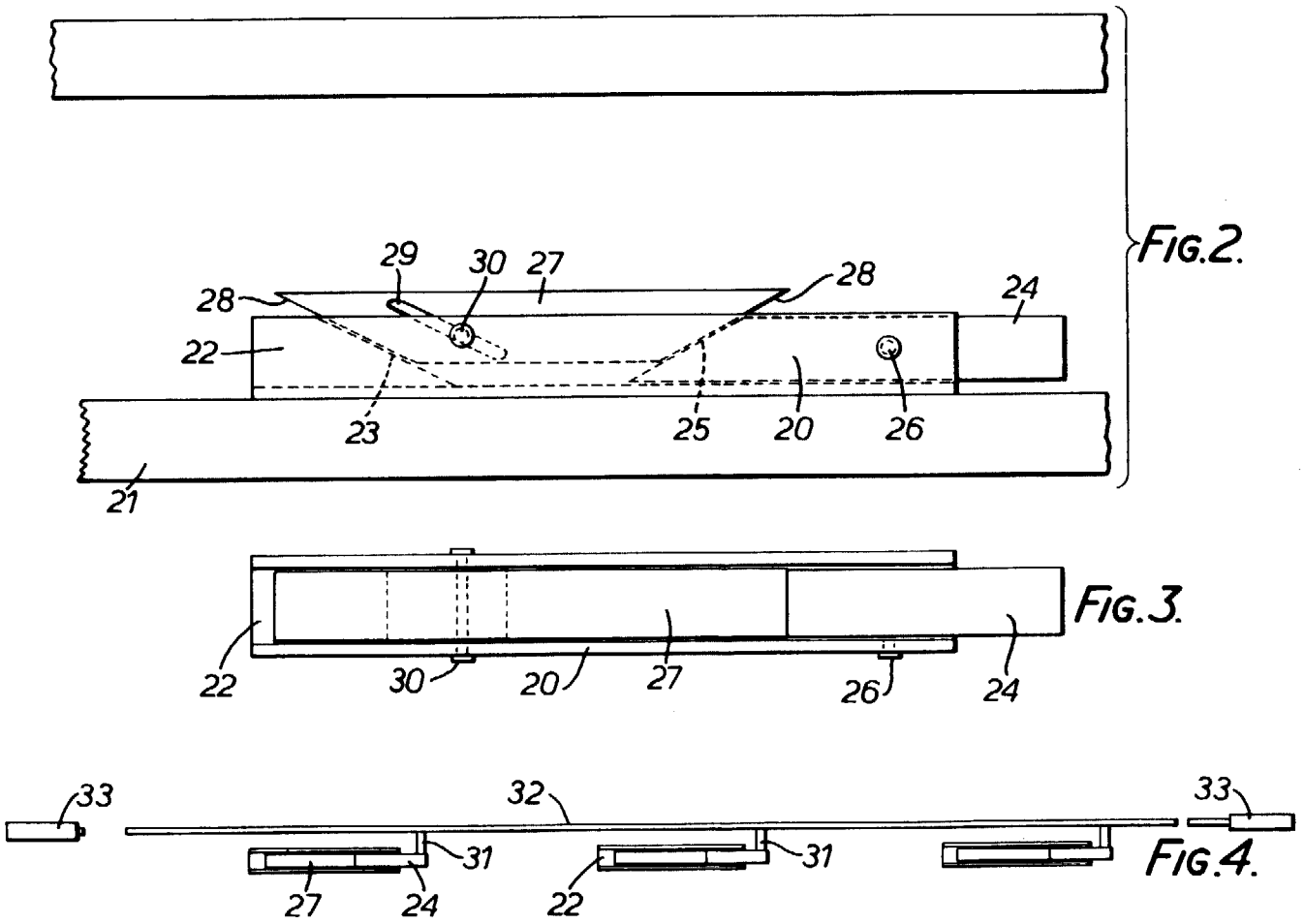
FIG. 2 is an elevation of an adjustable spacer.
FIG. 3 is a plan view of the spacer of FIG. 2.
FIG. 4 is a plan view of a set of automatically adjustable spacers.

Referring to FIGS. 2 and 3 a spacer comprises a channel 20 positioned on a freezer plate 21; a fixed stop 22 in the channel 1, the fixed stop having an inclined face 23; an adjustable stop 24 held in position lengthwise of the channel by a clamping screw 26 and having an inclined face 25; and a spacer block 27 of trapezoidal form having inclined faces 28. The inclination of faces 23 and 25 corresponds to the inclination of the faces 28 and the block 27 has an inclined slot 29, corrresponding in inclination to one of the inclined faces 28 of the block.

A guide pin 30 set in the walls of the channel 20 passes through slot 29. By lengthwise adjustment of the stop 24 the height of the upper face of the block above the surface of its associated plate is infinitely variable within the limits of the slot 29.

In place of the manually adjustable spacers described above, an automatically operable set of spacers may be provided as shown in FIG. 4 where the individual spacers are as shown in FIGS. 2 and 3 save that each adjustable stop 24, instead of being held by a clamping screw, is held by a spindle 31. The spindles 31 engage an operating bar 32 each end of which cooperates with a jack 33 through which the bar and hence the displaceable spacers is adjustable. A locking device may be provided for holding the bar in the portion set by the jacks.

Where automatically adjustable spacers are desired a control may be provided to jacks 33 located at the input level which will set the jacks to set the spacers to the size of product then at the input level.

Figure 1:
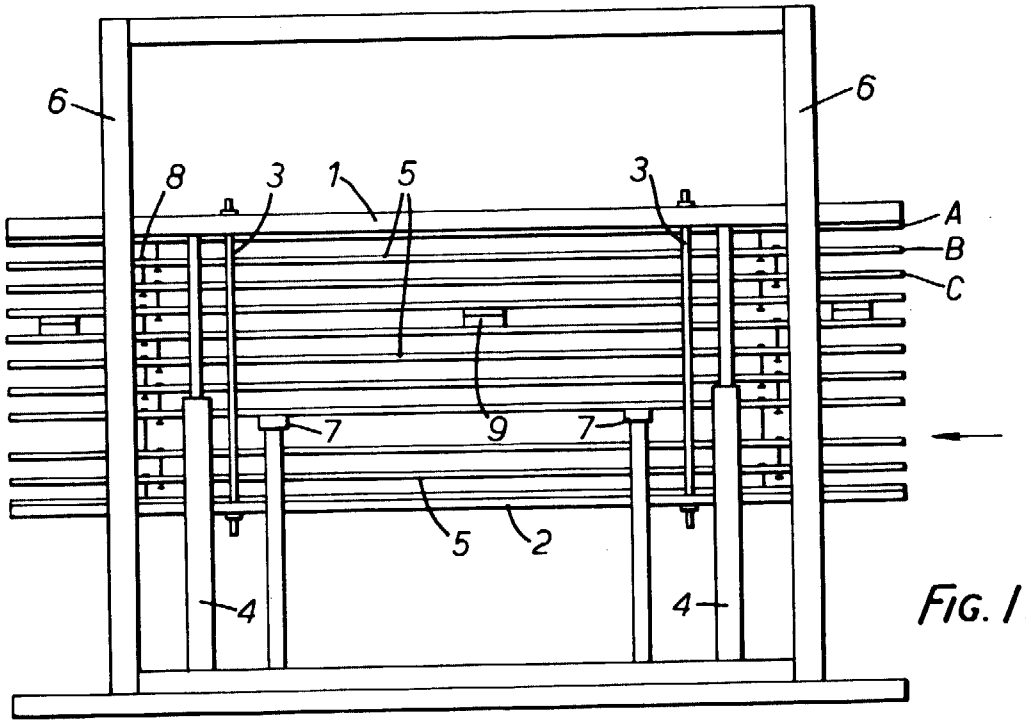
FIG. 1 is a diagrammatic elevation of the automatic plate freezer.

Referring again to FIG. 1 the use of adjustable spacers in place of the fixed spacers would, in the freezer of FIG. 1, require adjustment of the length of the tie rods to provide correct operation.

Figure 5:
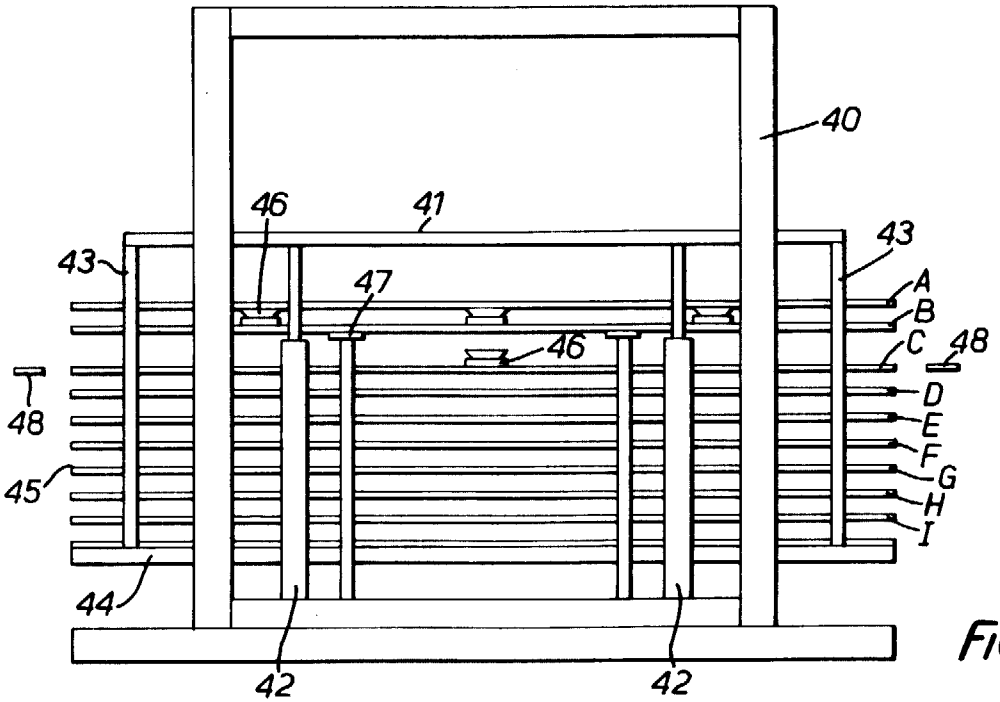
FIG. 5 is a diagrammatic elevation of an automatic plate freezer.

Referring to FIG. 5 there is shown a freezer in which different thicknesses of product can be accommodated without adjustment of tie rods, and thus without interrupting throughput of product. Such a freezer preferably incorporates the adjustable spacers described above.

The freezer of FIG. 5 comprises a pair of side guide frames 40, an upper support 41 movable by hydraulic jacks 42 and, suspended from support 41 by ties 43, a lower support 44. Between each adjacent pair of freezer plates 45 is a plurality of automatically adjustable spacers 46 such as shown in FIG. 4. Only exemplary spacers 46 are shown in the interests of clarity. Plate latches 47, during part of each operating cycle, are provided to support the plate at a vertically fixed location defined by the level of the latches 47, and with it all the plates located above the level of the latches.

In operation, with the freezer in the configuration shown in FIG. 5, the plate C is ready to be loaded, the upper surface of the plate C being at a vertically fixed predetermined position defining a loading plane. Items to be frozen are loaded on to plate C, and the adjustable spacers 46 associated with this plate (only one such spacer being shown in the interests of clarity) are set to provide the plate spacing desired for the product in question. Jacks 42 are then extended to lift the upper support 41, and via ties 43, the lower support 44 and the plates C to I which are resting on the lower support. As lifting continues the spacers of plate C engage plate B and thereafter the entire stack of plates is raised until plate C is engaged by latches 47. The jacks 42 are then retracted and the plates D to I are lowered, the plates A to C being supported on the latches 47. Lowering continues until fixed sensors 48 detect that plate D is at the loading level, with the upper surface of the plate in the vertically fixed predetermined position defining the loading plane previously occupied by the upper surface of plate C whereupon the jacks are held to hold the plates D to I whilst plate D is loaded. The cycle is then repeated.

Preferably four jacks 42 are provided, two on each side of the stack of plates, and four sensors 48 are provided, one at each corner of the stack. In this case, each sensor is preferably set to detect when the adjacent corner of a plate is at the correct loading level, and each sensor upon detecting the adjacent plate corner stops the adjacent jack. In this manner it is assured that each plate will be in exactly the correct plane for loading.

Various modifications may be adopted in the above described embodiments, such as use of electrically actuated jacks, and the use of rotary cams or the like to adjust the height of the spacers.

I claim:

1. A plate freezer comprising a stack of freezer plates; spacer means between each pair of adjacent plates enabling each plate to be supported on the plate below with a spacing therebetween determined by the spacer means; latch means for supporing a plate at a vertically fixed location defined by the level of the latch means at a vertically fixed location; and lifting-and-lowering means for sequentially lifting the plates in the stack to locate a plate for support by the latch means at said vertically fixed location, and then lowering those plates in the stack located below the latch means until the plate next below the latch means is at a vertically fixed predetermined position, the lifting-and-lowering means being repeatedly operable to locate successive plates in the stack at said vertically fixed predetermined position below said latch means, and sensor means for detecting when a plate is at said predetermined position and then terminating lowering of the plate to maintain it in said vertically fixed predetermined position.

2. A plate freezer according to claim 1 wherein said sensor means comprises a plurality of sensors each for detecting when an adjacent portion of a plate is at predetermined location relative to the sensor, and wherein the lifting-and-lowering means comprises a plurality of jacks each of which is separately controlled by a respective sensor.

3. A plate freezer according to claim 1 wherein, whilst a plate is maintained in said vertically fixed predetermined position, the lifting-and-lowering means hold the weight of the plates located below the latch means.

4. A plate freezer according to claim 1 wherein the spacer means are adjustable to vary the spacing between the plates.

5. A plate freezer according to claim 4 wherein the spacer means associated with a plate which is being loaded with a product to be frozen are automatically set to provide a spacing between that plate and the plate above suitable for the product to be frozen.

6. A plate freezer according to claim 4 wherein the spacer means associated with each plate comprises a plurality of individual spacers each comprising a base member mounted on the associated plate and a spacer block adjustably mounted on the base member.

7. A plate freezer according to claim 6 wherein each spacer block is trapezoidal in shape and includes two downwardly inwardly converging faces which rest on correspondingly inclined faces of a fixed stop and a movable stop, the movable stop being movable towards and away from the fixed stop to vary the vertical position of the spacer block.

8. A plate freezer according to claim 7 wherein each spacer block includes a slot which extends parallel to one of the inclined faces thereof, and wherein a pin secured to the base passes through the slot to control movement of the spacer block.

9. A plate freezer according to claim 4 wherein the spacer means are infinitely adjustable within their limits of adjustability.

* * * * *